US011468809B2

(12) United States Patent
Nho et al.

(10) Patent No.: US 11,468,809 B2
(45) Date of Patent: Oct. 11, 2022

(54) LOW-FLICKER VARIABLE REFRESH RATE DISPLAY

(71) Applicant: Apple Inc., Cupertino, CA (US)

(72) Inventors: Hyunwoo Nho, Palo Alto, CA (US); Wei Chen, Palo Alto, CA (US); Wei H Yao, Palo Alto, CA (US); Yafei Bi, Palo Alto, CA (US)

(73) Assignee: Apple Inc., Cupertino, CA (US)

( * ) Notice: Subject to any disclaimer, the term of this patent is extended or adjusted under 35 U.S.C. 154(b) by 1461 days.

(21) Appl. No.: 14/591,354

(22) Filed: Jan. 7, 2015

(65) Prior Publication Data

US 2016/0196802 A1 Jul. 7, 2016

(51) Int. Cl.
*G09G 3/20* (2006.01)

(52) U.S. Cl.
CPC ..... *G09G 3/20* (2013.01); *G09G 2310/027* (2013.01); *G09G 2310/08* (2013.01); *G09G 2320/0247* (2013.01); *G09G 2320/0626* (2013.01); *G09G 2320/0673* (2013.01); *G09G 2320/103* (2013.01); *G09G 2330/021* (2013.01); *G09G 2340/0435* (2013.01)

(58) Field of Classification Search
CPC ..... G09G 2310/08; G09G 3/20; G09G 2310/027; G09G 2320/0247; G09G 2320/0626; G09G 2320/0673; G09G 2320/103; G09G 2330/021; G09G 2340/0435
See application file for complete search history.

(56) References Cited

U.S. PATENT DOCUMENTS

| | | | | |
|---|---|---|---|---|
| 8,228,354 | B2 | 7/2012 | Yoshida et al. | |
| 8,570,314 | B2 | 10/2013 | Hasegawa et al. | |
| 9,197,847 | B2 * | 11/2015 | Mori | G09G 5/00 |
| 9,230,476 | B2 * | 1/2016 | Park | G09G 5/10 |
| 9,251,756 | B2 * | 2/2016 | Choi | G09G 3/3648 |
| 9,613,554 | B2 * | 4/2017 | Jang | G09G 3/2007 |
| 9,728,142 | B2 * | 8/2017 | Nicholson | G09G 3/3406 |
| 2001/0028346 | A1 * | 10/2001 | Kudo | G09G 3/3622 345/204 |
| 2002/0036603 | A1 * | 3/2002 | Nagakubo | G09G 3/2022 345/60 |
| 2002/0154077 | A1 | 10/2002 | Wakita | |

(Continued)

*Primary Examiner* — Jeff Piziali
(74) *Attorney, Agent, or Firm* — Treyz Law Group, P.C.; G Victor Treyz; Tianyi He

(57) ABSTRACT

An electronic device may have a variable refresh rate display. Static content may be displayed on the display at a lower refresh rate than moving content to conserve power. The display may include an array of pixels. Display driver circuitry in the display may load image data into rows of the pixels. The display driver circuitry may have digital-to-analog converter circuitry that supplies data signals to the array. The display driver circuitry may respond to a variable refresh rate control signal that is asserted and deasserted depending on whether static or moving image content is to be displayed. The display driver circuitry may use the digital-to-analog converter circuitry to apply a time-varying scaling factor to the image data. The magnitude of the scaling factor may be adjusted during transitions between refresh rates to help suppress luminance variations that might otherwise result in flickering on the display.

19 Claims, 10 Drawing Sheets

(56) References Cited

U.S. PATENT DOCUMENTS

| | | | | |
|---|---|---|---|---|
| 2003/0184569 | A1* | 10/2003 | Koga | G09G 3/2003 345/690 |
| 2005/0280615 | A1* | 12/2005 | Cok | G09G 3/3216 345/77 |
| 2006/0146005 | A1* | 7/2006 | Baba | G09G 3/3233 345/102 |
| 2010/0149167 | A1* | 6/2010 | Hasegawa | G09G 3/3225 345/213 |
| 2011/0187754 | A1* | 8/2011 | Yoo | G09G 3/30 345/690 |
| 2012/0081419 | A1* | 4/2012 | Abe | G09G 3/3426 345/691 |
| 2012/0256818 | A1 | 10/2012 | Kuroki | |
| 2014/0063078 | A1* | 3/2014 | Choi | G09G 3/22 345/690 |

* cited by examiner

LOW-FLICKER VARIABLE REFRESH RATE DISPLAY

BACKGROUND

This relates generally to displays, and, more particularly, to variable refresh rate displays.

Electronic devices often include displays. Display driver circuitry is used to apply control signals to an array of pixels in a display. The array of pixels is used to display images for a user.

The process of using the display driver circuitry to display images on the array of pixels in a display consumes power. As each frame of image data is loaded, capacitances associated with signal lines and capacitors in the pixel structures are charged and discharged. The amount of power consumed by these charging and discharging operations is related to the rate at which frames of data are refreshed in the display. Displays that operate at lower refresh rates tend to consume less power, but may not be able to smoothly play moving images for a viewer.

To help conserve power, some displays implement variable refresh rate schemes. When the display is being used normally, the display is refreshed at a high refresh rate that is suitable for displaying moving images. When static content is present, the refresh rate of the display is reduced to lower power consumption.

It can be challenging to implement a variable refresh rate scheme. If care is not taken, the display may exhibit undesirable visible artifacts such as transient flickering when transitioning between different refresh rates.

It would therefore be desirable to be able to provide improved techniques for controlling refresh rates in displays.

SUMMARY

An electronic device may have a variable refresh rate display. Control circuitry in the electronic device may analyze image data to detect moving image content and static image content. Static image content may be displayed on the display at a lower refresh rate than the moving image content to conserve power.

The display may include an array of pixels. Display driver circuitry in the display may load image data into rows of the pixels. The display driver circuitry may respond to a variable refresh rate control signal from the control circuitry that is asserted and deasserted depending on whether static or moving image content is to be displayed.

The display driver circuitry may have digital-to-analog converter circuitry that supplies data signals to the array of pixels. The display driver circuitry may use the digital-to-analog converter circuitry to apply a time-varying scaling factor to the image data. The magnitude of the scaling factor may be adjusted during transitions between refresh rates to help suppress luminance variations that might otherwise result in flickering on the display.

DETAILED DESCRIPTION

Figure 1:
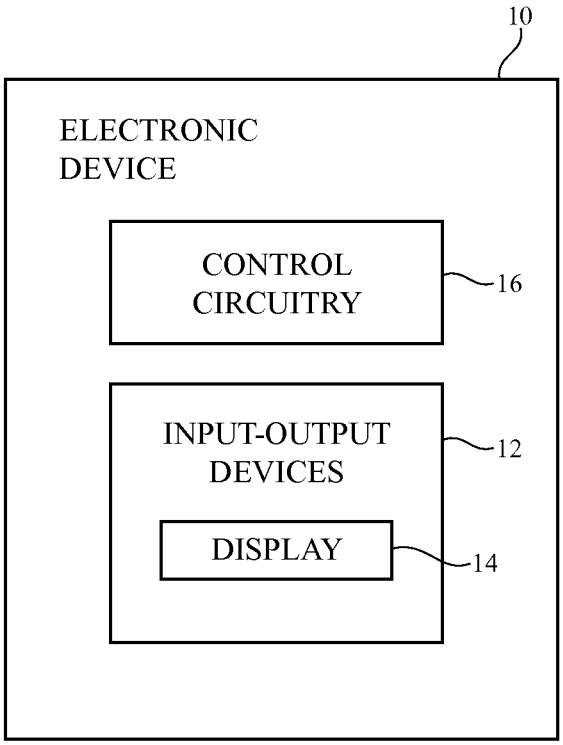
FIG. 1 is a diagram of an illustrative electronic device having a display in accordance with an embodiment.

An illustrative electronic device of the type that may be provided with a display is shown in FIG. 1. As shown in FIG. 1, electronic device 10 may have control circuitry 16. Control circuitry 16 may include storage and processing circuitry for supporting the operation of device 10. The storage and processing circuitry may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in control circuitry 16 may be used to control the operation of device 10. The processing circuitry may be based on one or more microprocessors, microcontrollers, digital signal processors, baseband processors, power management units, audio chips, application specific integrated circuits, etc.

Input-output circuitry in device 10 such as input-output devices 12 may be used to allow data to be supplied to device 10 and to allow data to be provided from device 10 to external devices. Input-output devices 12 may include buttons, joysticks, scrolling wheels, touch pads, key pads, keyboards, microphones, speakers, tone generators, vibrators, cameras, sensors, light-emitting diodes and other status indicators, data ports, etc. A user can control the operation of device 10 by supplying commands through input-output devices 12 and may receive status information and other output from device 10 using the output resources of input-output devices 12.

Input-output devices 12 may include one or more displays such as display 14. Display 14 may be a touch screen display that includes a touch sensor for gathering touch input from a user or display 14 may be insensitive to touch. A touch sensor for display 14 may be based on an array of capacitive touch sensor electrodes, acoustic touch sensor structures, resistive touch components, force-based touch sensor structures, a light-based touch sensor, or other suitable touch sensor arrangements.

Control circuitry 16 may be used to run software on device 10 such as operating system code and applications. During operation of device 10, the software running on control circuitry 16 may display images on display 14.

Display 14 may be a liquid crystal display, an organic light-emitting diode display, an electrophoretic display, an electrowetting display, or any other suitable type of display. Configurations in which display 14 is an organic light-emitting diode are sometimes described herein as an example. This is, however, merely illustrative. Any suitable type of display may be used, if desired.

Figure 2:
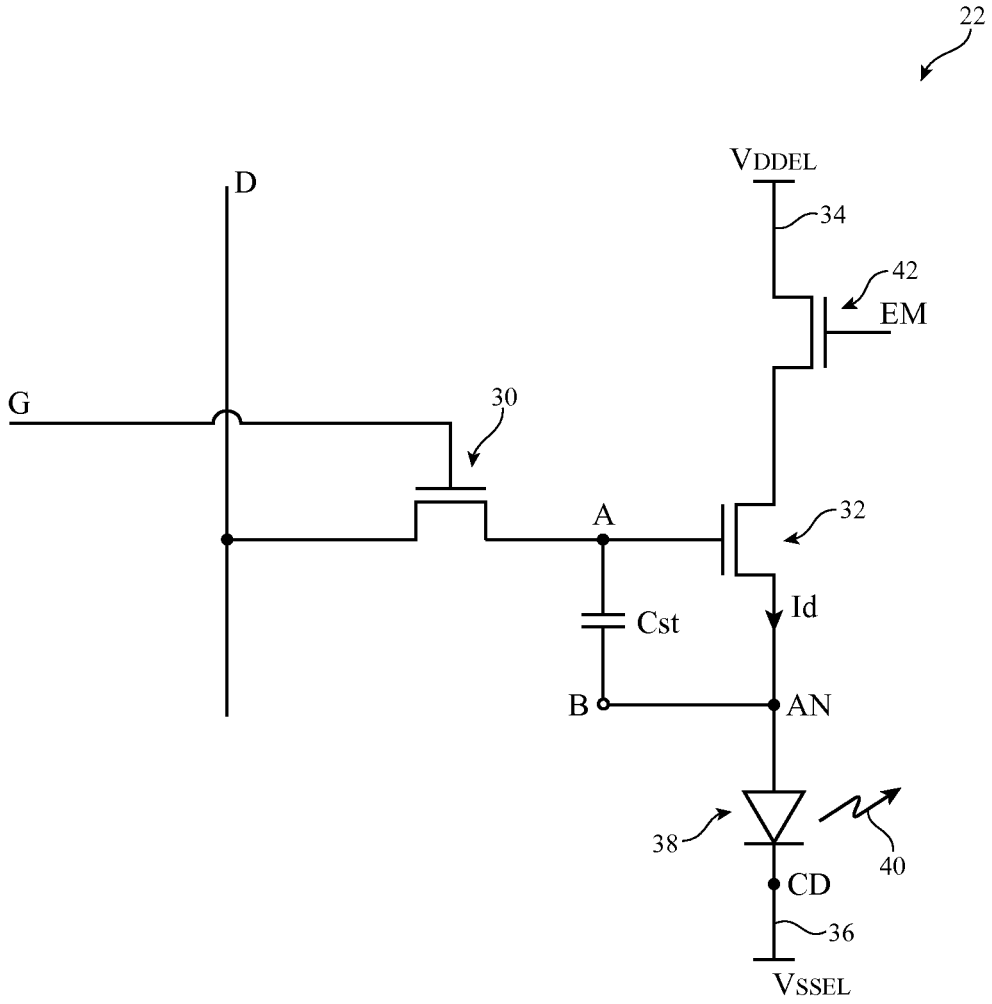
FIG. 2 is a diagram of an illustrative pixel circuit in a display in accordance with an embodiment.

In an organic light-emitting diode display, each pixel of the display contains a respective organic light-emitting diode. A schematic diagram of an illustrative circuit for a pixel in an organic light-emitting diode display is shown in FIG. 2. As shown in FIG. 2, pixel 22 may include an organic light-emitting diode such as organic light-emitting diode 38. A positive power supply voltage $V_{DDEL}$ may be supplied to positive power supply terminal 34 and a ground power supply voltage $V_{SSEL}$ may be supplied to ground power supply terminal 36.

Light-emitting diode 38 may emit colored light. For example, in a scenario in which pixel 22 is a red subpixel, organic light-emitting diode 38 may emit red light. Blue subpixels may have blue diodes 38 that emit blue light and green subpixels may have green diodes 38 that emit green light. Arrangements for display 14 in which pixels 22 have different colors (yellow, white, light blue, dark blue, etc.) may also be used.

In each pixel 22, the state of drive transistor 32 controls the amount of drive current $I_D$ flowing through diode 38 and therefore the amount of light 40 that is emitted from that pixel. Each diode 38 has an anode AN and a cathode CD. Drive current $I_D$ flows between anode AN and cathode CD. Cathode CD of diode 38 is coupled to ground terminal 36, so cathode terminal CD of diode 38 may sometimes be referred to as the ground terminal for diode 38. Cathode CD may be shared among multiple diodes (i.e., the cathodes CD of multiple diodes may be tied to a shared voltage). Each anode AN may be individually driven by a respective drive transistor 32.

To ensure that transistor 32 is held in a desired state between successive frames of data, pixel 22 may include a storage capacitor such as storage capacitor Cst. The voltage on storage capacitor Cst is applied to the gate of transistor 32 to control transistor 32 (i.e., to control the magnitude of drive current $I_D$).

Data can be loaded into storage capacitor Cst using one or more switching transistors. One or more emission enable transistors may be used in controlling the flow of current through drive transistor 32. There may be any suitable number of transistors in each pixel. In the example of FIG. 2, transistor 30 serves as a switching transistor that controls data loading onto node A, transistor 32 is a drive transistor, and transistor 42 is an emission enable transistor. Configurations for pixels such as pixel 22 with different numbers of transistors may be used, if desired.

In the example of FIG. 2, control signal G is being applied to the gate of switching transistor 30 (e.g., to turn on transistor 30 when it is desired to load data from data line D to node A) and control signal EM is being applied to the gate of emission enable transistor 42 (e.g., to disable transistor 32 during threshold voltage compensation and data loading operations and to enable transistor 32 during light emission operations). The control signals that are applied to pixel 22 may be applied to all of the pixels 22 in a row of display 14 at the same time and may be used for controlling the transistors in that row during threshold voltage compensation operations, data loading operations, and emission operations.

Figure 3:
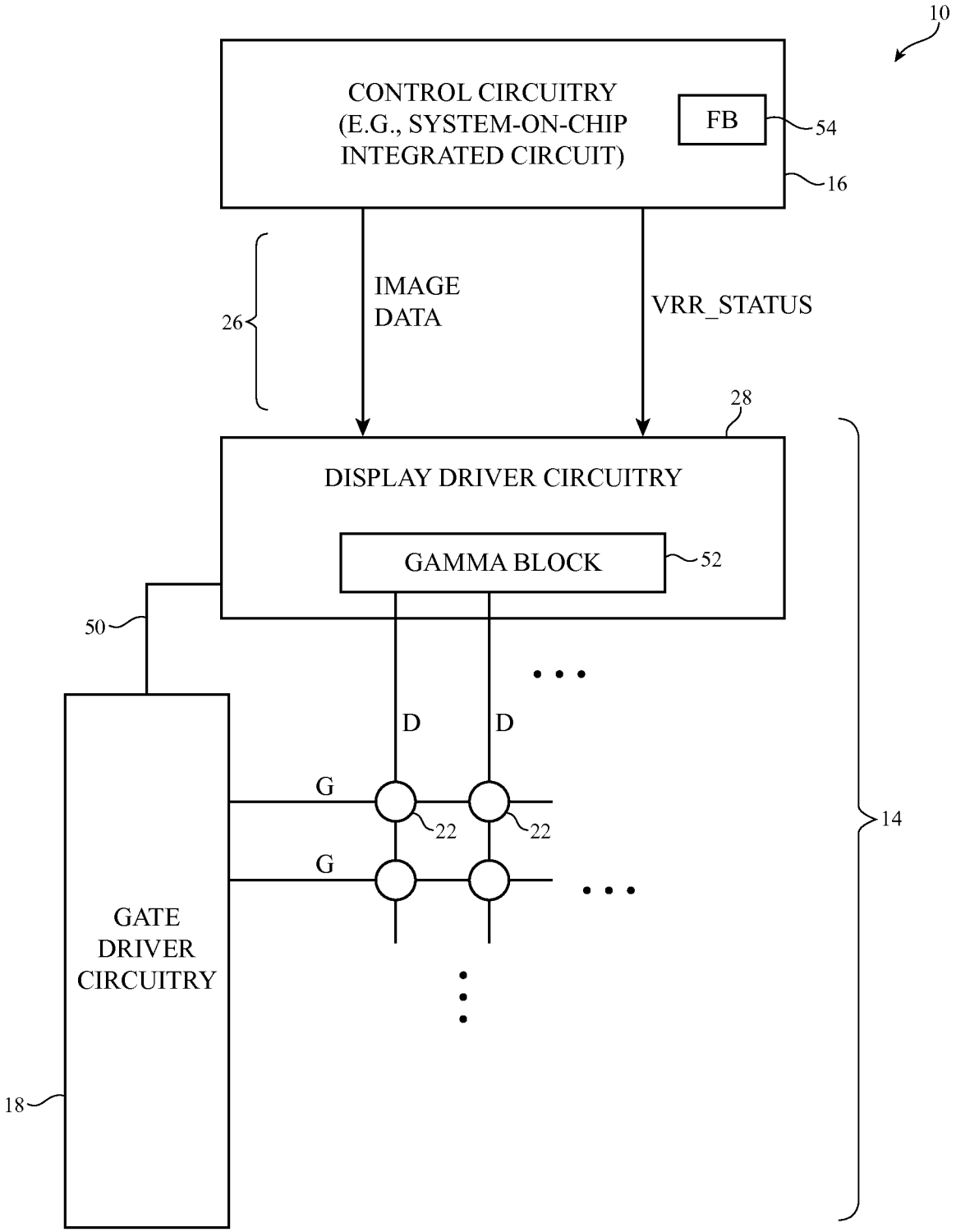
FIG. 3 is a diagram of an illustrative display in accordance with an embodiment.

FIG. 3 is a schematic diagram of an illustrative display in device 10. As shown in FIG. 2, display 14 may have an array of pixels 22 for displaying images for a user. The pixels of the array may be arranged in rows and columns. There may be any suitable number of rows and columns in the array of pixels 22 (e.g., ten or more, one hundred or more, or one thousand or more). The array of pixels 22 may include pixels 22 of different colors. As an example, display 14 may have red pixels that emit red light, green pixels that emit green light, and blue pixels that emit blue light. Configurations for display 14 that include pixels of other colors may be also be used, if desired.

Display driver circuitry may be used to control the operation of pixels 22. The display driver circuitry may be formed from integrated circuits, thin-film transistor circuits, or other suitable circuitry. Display driver circuitry 28 of FIG. 3 may contain communications circuitry for communicating with system control circuitry such as control circuitry 16 (e.g., a system-on-chip integrated circuit and/or other processing circuitry) over path 26. Path 26 may be formed from traces on a flexible printed circuit or other cable and may be used for conveying image data and control signals between control circuitry 16 and display 14. Path 26 may, as an example, carry a control signal such as variable refresh rate status signal VRR_STATUS that is used in selecting a desired refresh rate for display 14.

During operation, display 14 may display images corresponding to the image data received on path 26. To display the images on pixels 22, display driver circuitry 28 may supply image data to data lines D using digital-to-analog converter circuitry such as gamma block circuitry 52 while issuing clock signals and other control signals to supporting display driver circuitry such as gate driver circuitry 18 over path 50. If desired, circuitry 28 may also supply clock signals and other control signals to gate driver circuitry on an opposing edge of display 14. The circuits of display driver circuitry 28 and gate driver circuitry 18 allow data to be refreshed in the array of pixels 22 at various different refresh rates (i.e., display 14 is a variable refresh rate display).

Gate driver circuitry 18 (sometimes referred to as horizontal control line control circuitry) may be implemented as part of an integrated circuit and/or may be implemented using thin-film transistor circuitry. Horizontal control lines G in display 14 may supply gate line signals (scan line signals), emission enable control signals, and other horizontal control signals for controlling the pixels of each row. There may be any suitable number of horizontal control signals per row of pixels 22 (e.g., one or more, two or more, three or more, four or more, etc.).

Each column of pixels 22 receives image data on a corresponding data line D. During data loading operations, data is loaded from data lines D into the pixels 22 of a given row of display 14. Gate driver circuitry 18 contains circuitry such as shift register circuitry that asserts an output signal (or multiple output signals) in each row in succession, starting at the first row of pixels 22 and ending with the last row of pixels 22. In this way, frames of image data may be loaded into display 14 for viewing by a user.

To conserve power, the rate at which image data is loaded (i.e., the rate at which each frame of image data is refreshed by loading data into its rows in sequence using gate driver circuitry 18) may be reduced when display 14 is only need to display static content. Control circuitry 16 may analyze images that are to be displayed on display 14 by examining the contents of frame buffer 54. Control circuitry 16 may, for example, examine the contents of frame buffer 54 to determine whether upcoming content that is to be displayed on display 14 contains moving content or static content.

To ensure a satisfactory viewing experience for the user of device 10, some or all moving content may be displayed using a relatively high refresh rate (e.g., 60 Hz, 30 Hz, or other suitably high rate for displaying images that change rapidly). To conserve power, content that is static or nearly static may be displayed using a relatively low refresh rate (e.g., a refresh rate of 1 Hz, 2 Hz, or other suitably low rate for minimizing display power consumption). During operation, control circuitry 16 can analyze the image data in storage such as buffer 54 to determine whether image content is moving or static and may issue corresponding control signals on path 26. As an example, one or more control signals such as control signal VRR_STATUS may be deasserted when moving content is present and may be asserted when static content is present.

Display driver circuitry 28 may adjust display control signals such as one or more clock and control signals on path 50 in response to the refresh rate control signal VRR_STATUS to ensure that display 14 is being refreshed at an appropriate rate. To help avoid visual artifacts on display 14 such as flickering output, display driver circuitry 28 may use gamma block 52 to scale the magnitude of output data D in accordance with a scaling factor. The scaling factor can be adjusted as a function of time to minimize visible changes in the output of display 14 when transitioning between different refresh rates.

In the absence of the scaling factor, there is a potential for undesirable display artifacts such as flickering when transitioning between refresh rates. Consider, as an example, a scenario in which a display has 200 rows of pixels. During normal operation at a refresh rate of 60 Hz (for example), one out of the 200 rows will be turned off (dark) at any given time to accommodate data loading into that row. If the luminance of the display is L when all 200 rows of pixels are simultaneously supplying light output, then the luminance of the display during normal operation will be (199/200)*L (i.e., the display luminance will be 0.995 L). If the refresh rate of the display is dropped to 1 Hz, all 200 lines of the display will effectively be continuously on (i.e., the display luminance will rise to L from 0.995 L), which can cause the display to flicker. The same type of flickering can arise when transitioning from the low refresh rate (1 Hz) back to the high refresh rate (e.g., 60 Hz) associated with normal operation.

Figure 4:
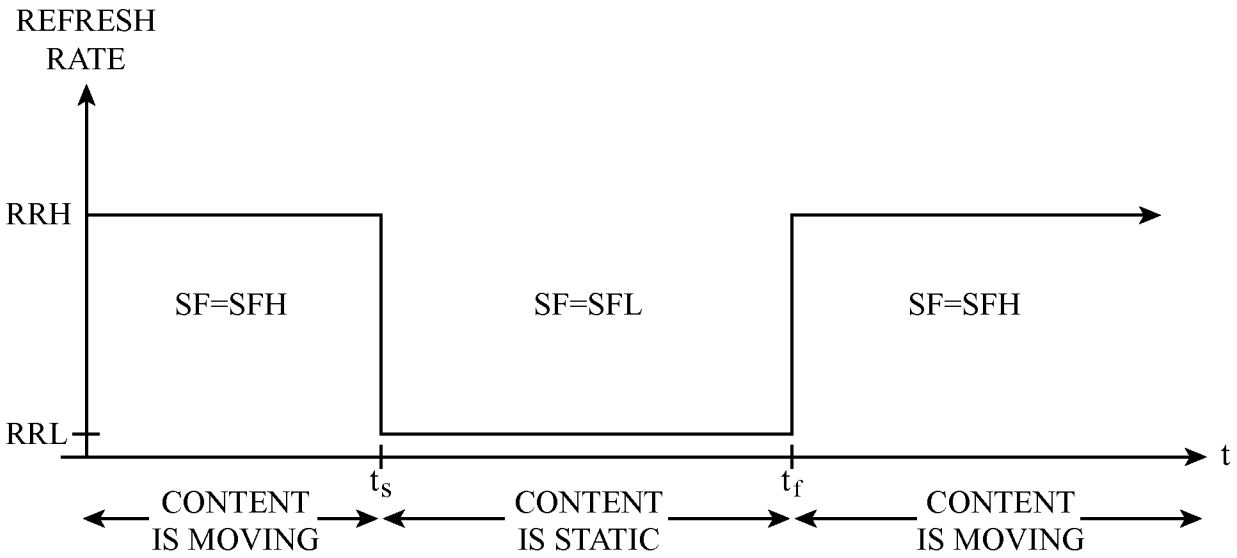
FIG. 4 is a graph showing how refresh rate changes may be made to a display in the presence of moving and static image content in accordance with an embodiment.

When a time-varying scaling factor is used to adjust the magnitude of data signals D, potentially abrupt display luminance variations such as these can be avoided. The way in which this type of arrangement may be used in controlling the operation of display 14 is shown in FIG. 4. In the graph of FIG. 4, display refresh rate for display 14 has been plotted as a function of time. With the example of FIG. 4, moving images are being displayed at times before time $t_s$ and at times after time $t_f$. In the period of time between $t_s$ and $t_f$, only static content is being displayed.

To accommodate the moving content, the variable refresh rate of display 14 is initially set to a relatively high value of RRH. In the presence of the static content, the high refresh rate is not needed to smoothly display images on display 14, so the refresh rate can be lowered to a relatively low value of RRL. The magnitudes of RRH and RRL may have any suitable values. With one example, RRH is 60 Hz and RRL is 1 Hz. Other refresh rate values may be used when operating display 14, if desired.

The value of data D that is supplied to the array of pixels 22 in display 14 may be scaled using scaling factor SF. If, for example, a given data signal D has a voltage value of D1 before scaling, the scaled value of D that is loaded into a given pixel would be SF*D1 (i.e., D would be SF*D1 after the scaling factor has been applied). During normal operation of display 14 at refresh rate RRH, scaling factor SF may be set to a first value SFH. During low refresh rate operation at rate RRL, scaling factor SF may be set to a second value SFL. Scaling factors adjustments may be made so as to reduce visible display artifacts such as flickering by balancing the luminance between the high refresh rate periods and low refresh rates periods.

With one illustrative configuration, a default scaling factor SF of 1.0 may be applied to display 14 during operation at high refresh rate RRH. When a scaling factor of 1.0 is applied to data D, the luminance of display 14 will be 0.995 L during normal operation at rate RRH (in an illustrative example where display 14 has 200 rows of pixels 22). When it is desired to reduce the refresh rate to RRL, the scaling factor SF may be adjusted to 0.995. At low refresh rate RRL, the time occupied by data loading relative to the frame period (e.g., a 1 s frame period) is negligible and all 200 rows of display 14 are effectively on continuously. Without application of the scaling factor, the luminance of display 14 would increase to 1.005 L when transitioning from rate RRH to rate RRL. By changing the scaling factor SF from 1.0 to 0.995 when transitioning from RRH to RRL at time $t_s$, the luminance of display 14 is maintained close to a constant level (0.995 L), thereby minimizing flickering. Scaling factor SF may likewise be changed from 0.995 to 1.0 when returning to RRH from RRL at time $t_f$. Further minimization of visible display artifacts can be accomplished by using additional scaling factor values during refresh rate transmissions (e.g., by using multiple different scaling factor values when moving from RRL to RRH at time $t_f$).

An illustrative scenario in which scaling factor SF is varied as display 14 transitions into and out of a low refresh rate mode of operation is set forth in the diagrams of FIGS. 5, 6, 7, 8, and 9. In this example, display 14 has 200 rows of pixels 22 and has a luminance (light output) of L when all 200 rows of pixels 22 are simultaneously supplying output.

Figure 5:
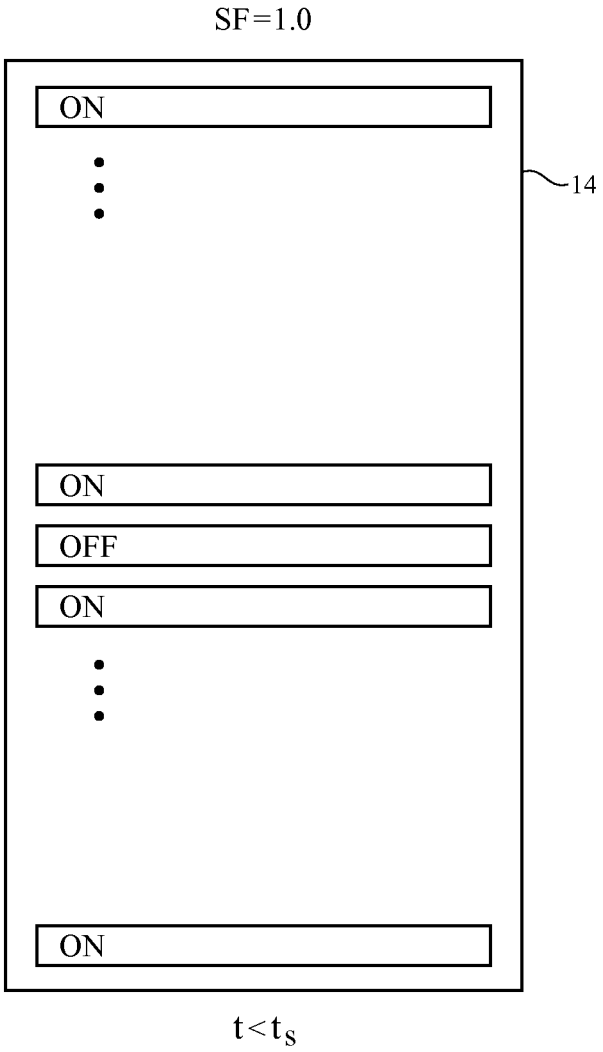
FIGS. 5, 6, 7, 8, and 9 are diagrams showing how a display output intensity scaling factor may be adjusted during transitions between different display refresh rates to minimize visible artifacts such as flickering in accordance with an embodiment.

Initially, at times $t<t_s$, display 14 is operated normally at high refresh rate RRH. In this scenario, one of the rows of pixels 22 is off at any given moment in time (in this example) so that data may be loaded into that row. This type of situation is illustrated in FIG. 5 in which rows of pixels 22 that are outputting light are labeled at being "ON," while the row into which data is being loaded and that is not outputting any light is labeled as being "OFF." The scaling factor SF in this situation is set to 1.0 and the resulting light output (luminance) of display 14 is 0.995 L.

By analyzing the image data that is being displayed on display 14 (e.g., by analyzing the image data in frame buffer 54), control circuitry 16 can detect that only static content will need to be displayed after time $t_s$ and can therefore assert variable refresh rate signal VRR_STATUS at time $t_s$. This directs display driver circuitry 28 to use gamma block 52 to adjust the magnitude of the output data signals D by applying a scaling factor SF of 0.995.

Figure 6:
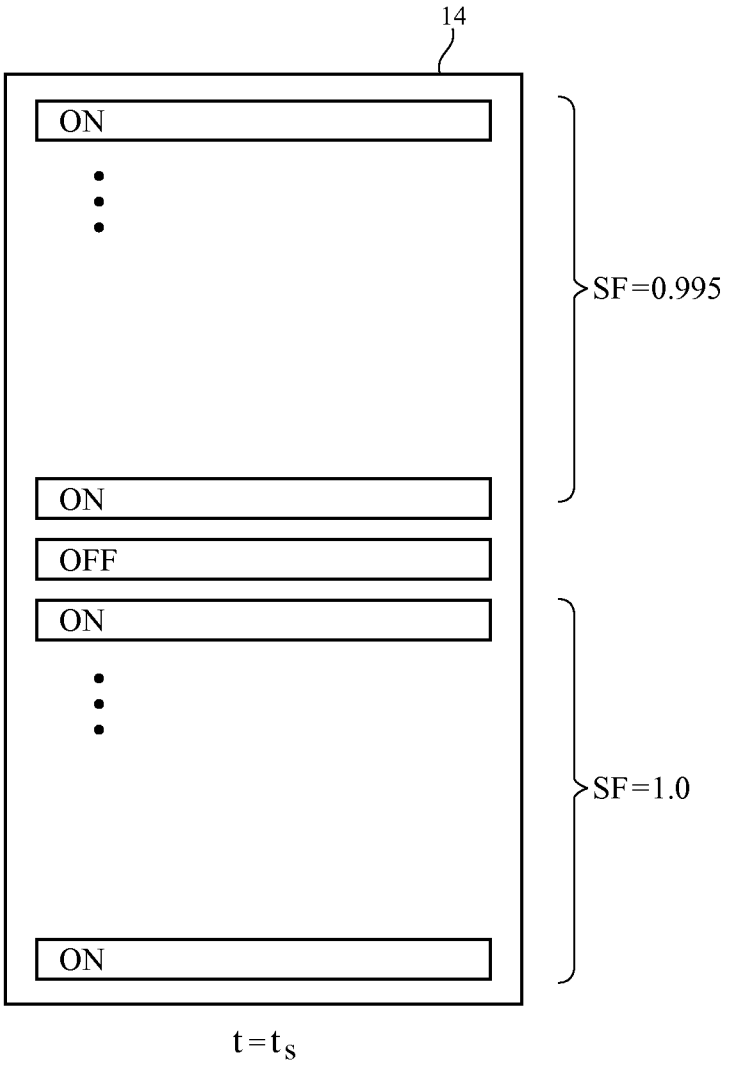

During the transition from the use of scaling factor 1.0 at times less than $t_s$ to the use of scaling factor 0.995 at times greater than $t_s$, display 14 will be in a transitional state with mixed scaling factors. As shown in FIG. 6, for example, rows above the OFF row will have been loaded with scaled data using the reduced scaling factor value of 0.995, whereas rows below the OFF row (i.e., the rows into which data has not yet been loaded) will still be using the original default scaling factor value of 1.0.

Figure 7:
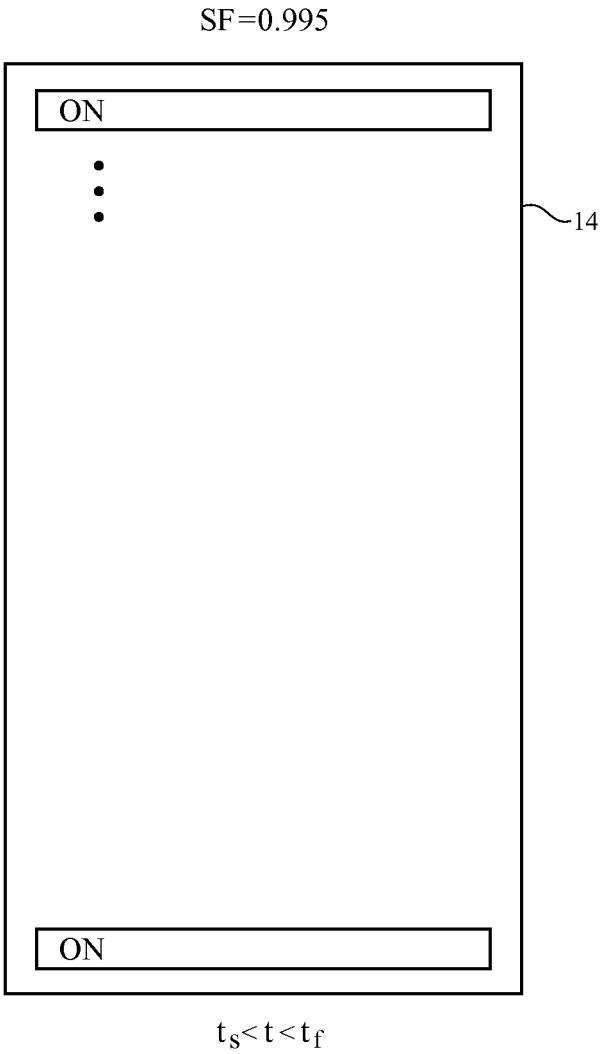

Once the transition of FIG. 6 is complete, display 14 will be operated at the low refresh rate of 1 Hz and all rows of pixels 22 in display 14 will effectively be continuously in the ON state, as shown in FIG. 7. Because the scaling factor of 0.995 has been applied to the data in all of the rows of display 14, the total luminance of display 14 will be 0.995 L. This is the same as the luminance value for display 14 at times before $t_s$, so flickering in the output of display 14 is minimized.

Figure 8:
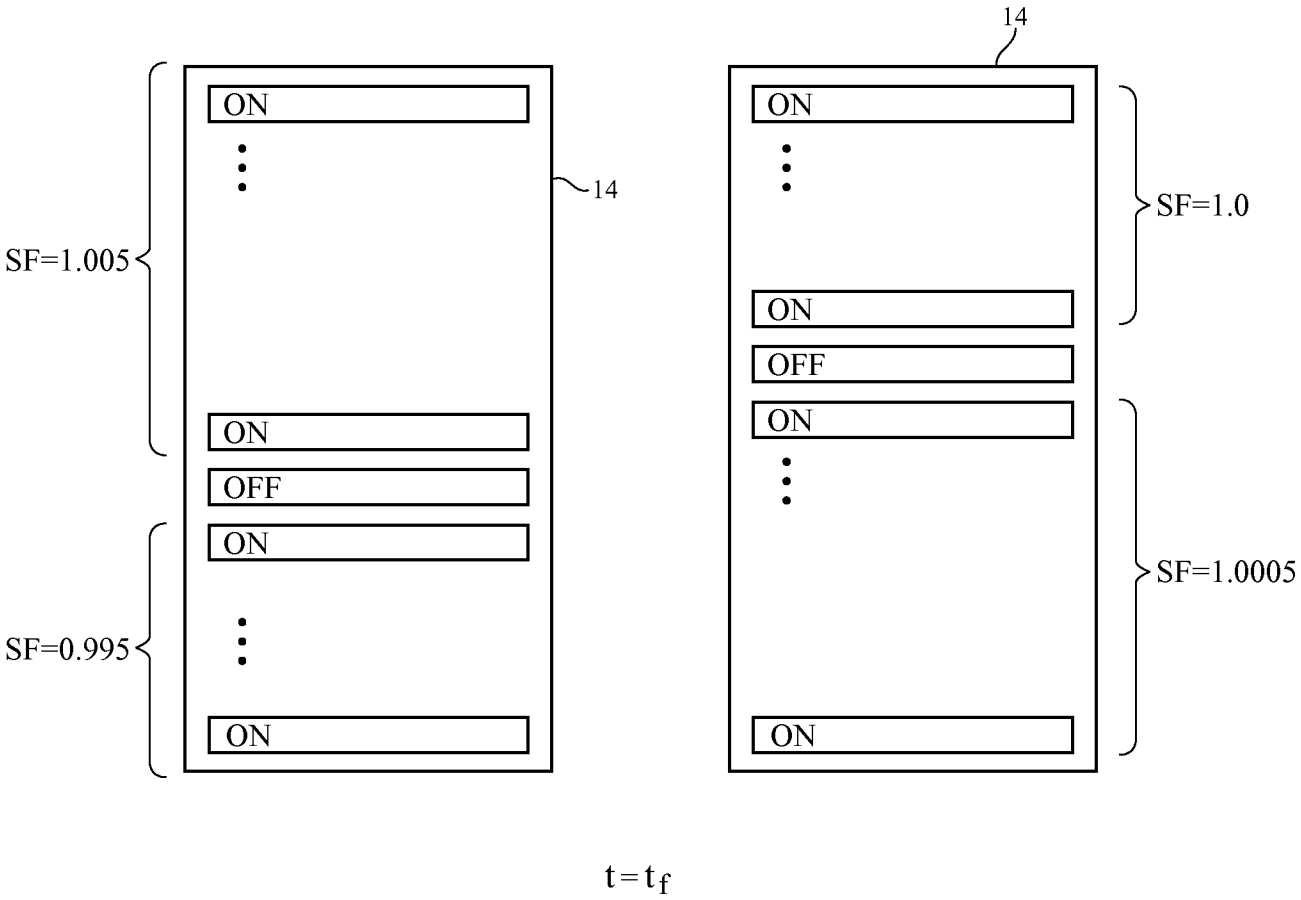
Figure 9:
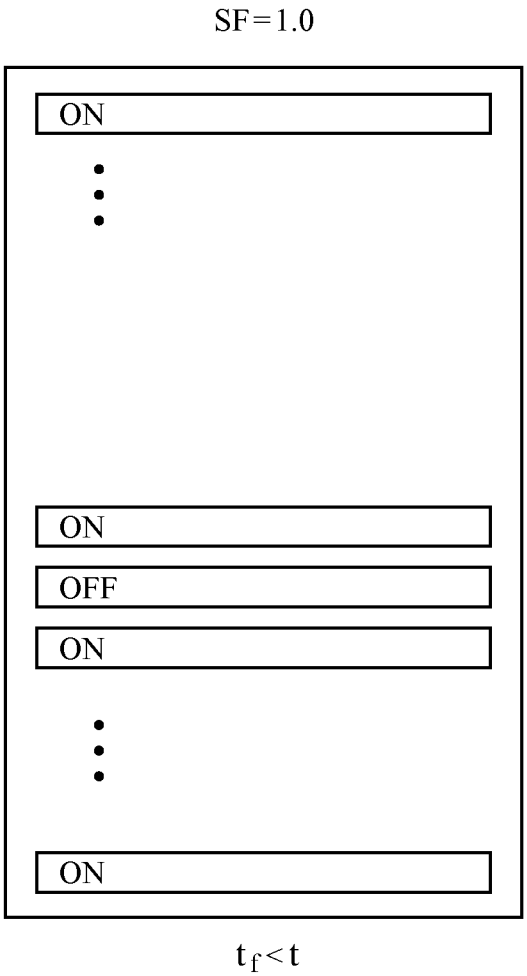

FIGS. 7 and 8 show how scaling factor SF may be adjusted when transitioning from the low refresh rate RRL to the high refresh rate at time $t_f$. During this transition, the rows of display 14, which were all on during the low refresh rate period will again have one row that is being used for data loading and is therefore off. The presence of the row of pixels that is off will decrease display luminance by 0.5% (in this example in which display 14 has 200 rows). As shown on the left side of FIG. 8, display 14 may therefore initially use an increased scaling factor of 1.005 in anticipation of the drop in luminance that will be produced due to the presence of the OFF row. This enhanced scaling factor value helps to compensate for the decrease in luminance that results from the OFF row and therefore helps to even out luminance variations. Once all rows of display 14 have been loaded with data with this new scaling factor (i.e., once all of the 0.995 scaling factor rows have been changed to 1.005 scaling factor rows), the scaling factor may be reduced to a lower value such as 1.0, as illustrated on the right side of FIG. 8. The value of 1.0 may then be sustained during the use of high refresh rate RRH at times greater than $t_f$, as shown in FIG. 9. Using the transitional scheme of FIG. 8 in which the scaling factor is momentarily increased before being returned to its default value, visible display artifacts may be minimized when transitioning from rate RRL to rate RRH. Other scaling factors and other changes in the scaling factor as a function of time and refresh rate may be used if desired. The illustrative arrangement of FIGS. 5, 6, 7, 8, and 9 is merely illustrative.

Figure 10:
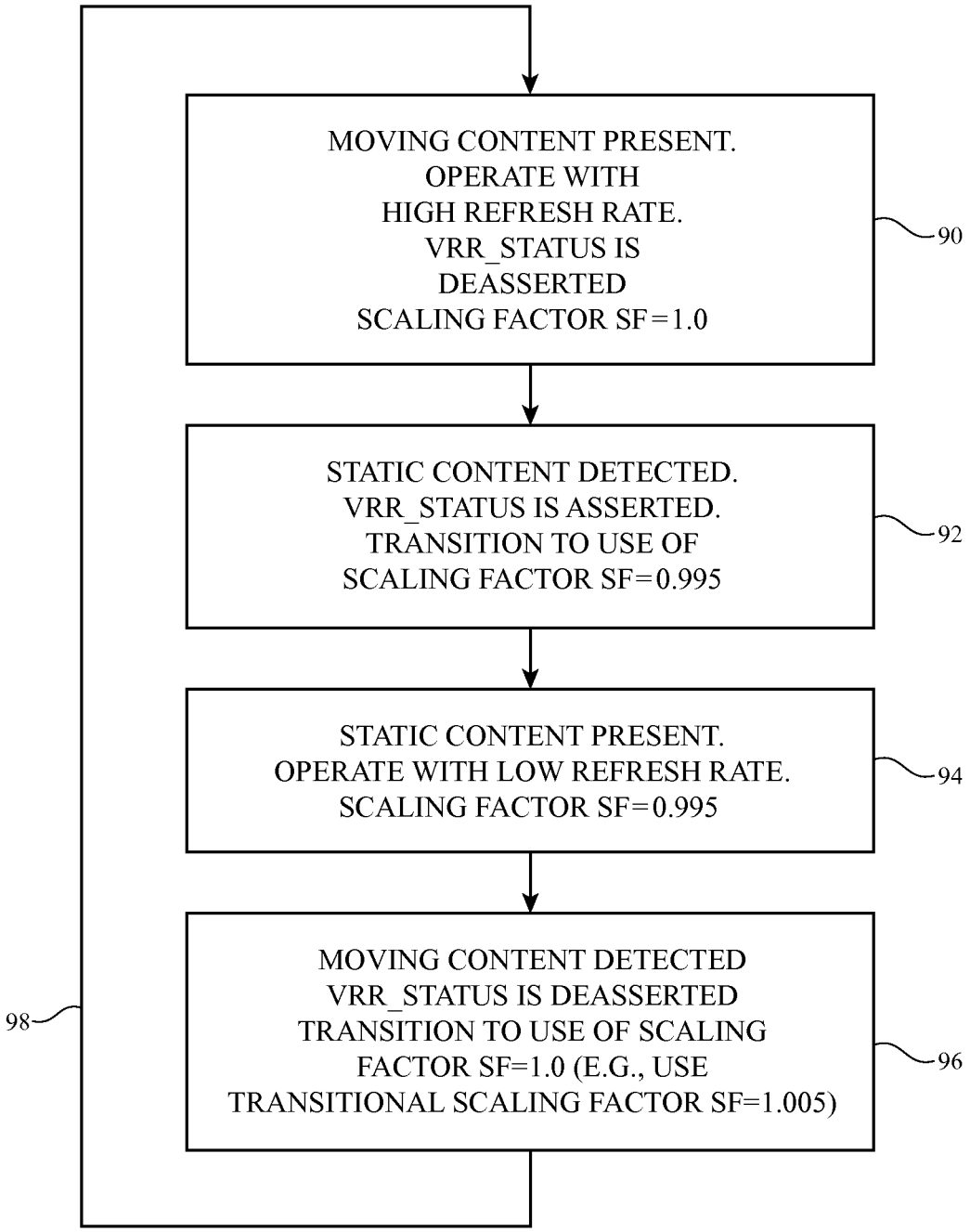
FIG. 10 is a flow chart of illustrative steps involved in operating a display while making refresh rate adjustments and data scaling factor in accordance with an embodiment.

FIG. 10 is a flow chart of illustrative steps involved in operating device 10 in a configuration in which device 10 has a display with a variable refresh rate and an adjustable scaling factor.

At step 90, device 10 presents moving content on display 14 at a high refresh rate RRH (e.g., 60 Hz). Control circuitry 16 may sense the presence of moving content by analyzing frame buffer 54. So long as moving content is being displayed, variable refresh rate control signal VRR_STATUS may be deasserted so that display driver circuitry 28 (and digital-to-analog converter circuitry such as gamma block 52) will apply a default scaling factor of 1.0 to the data signals D being supplied to the rows of pixels 22 in display 14. During the operations of step 90, control circuitry 16 may continue to analyze the image data that is to be displayed on display 14 (e.g., frame buffer information can be analyzed to determine whether static content is present).

In response to detection of upcoming static image content, control circuitry 16 may assert the VRR_STATUS control signal or may otherwise direct display driver circuitry 28 and gamma block 52 apply a reduced scaling factor of 0.995 to the data being loaded into display 14 (step 92). The refresh rate of display 14 may be adjusted from RRH to RRL to conserve power.

During the operations of step 94, the low refresh rate RRL is used by display 14 and the reduced scaling factor of 0.995 is used. Static content is displayed on display 14 and power consumption is reduced due to the use of the low refresh rate. During step 94, control circuitry 16 may analyze the content in frame buffer 54, may monitor input-output devices 12 for a user input or a sensor input, or may otherwise monitor device 10 for the satisfaction of criteria indicative of an upcoming need to display moving content on display 14.

In response to detection of upcoming moving images for display 14, control circuitry 16 may deassert control signal VRR_STATUS and the refresh rate for display 14 may be increased to high refresh rate RRH to ensure that the moving content is displayed satisfactorily (step 96). During the transition between low refresh rate RRL and high refresh rate RRH, display driver circuitry 28 may, in response to detection of the deassertion of VRR_STATUS, raise the scaling factor SF to an elevated value (e.g., 1.005) and then lower the scaling factor SF to the default value of 1.0. As described in connection with FIG. 8, this adjustment of the scaling factor may help minimize luminance variations for display 14 during the transition between rate RRL and rate RRH.

Following the transition to refresh rate RRH, processing may loop back to step 90 for additional operation of display 14 at high refresh rate RRH, as indicated by line 98.

The foregoing is merely illustrative and various modifications can be made by those skilled in the art without departing from the scope and spirit of the described embodiments. The foregoing embodiments may be implemented individually or in any combination.

What is claimed is:

1. A display, comprising:

display driver circuitry that is operable to receive image data for first and second different images and that comprises digital-to-analog converter circuitry; and an array of pixels coupled to the display driver circuitry using a plurality of data lines and operable to display the first image at a first refresh rate and to subsequently display the second image at a second refresh rate that is different from the first refresh rate, wherein the display driver circuitry is operable to apply a time-varying scaling factor to the image data for the first and second images to reduce a flickering associated with a transition from the first refresh rate to the second refresh rate, wherein the display driver circuitry is operable to load the image data for the first and second images applied with the time-varying scaling factor into the array of pixels using the plurality of data lines, wherein the time-varying scaling factor is at a first level before the transition from the first refresh rate to the second refresh rate and is at a second level after the transition from the first refresh rate to the second refresh rate, and wherein the first level is different from the second level.

2. The display defined in claim 1 wherein the second refresh rate is lower than the first refresh rate, wherein the digital-to-analog converter circuitry is operable to apply the time-varying scaling factor at the first level to the image data for the first image, and wherein the digital-to-analog converter circuitry is operable to apply the time-varying scaling factor at the second level to the image data for the second image.

3. The display defined in claim 2 wherein the second level is smaller than the first level.

4. The display defined in claim 3 wherein the digital-to-analog converter circuitry is operable to apply the time-varying scaling factor at a third level that is different from the first level and different from the second level to image data for a third image during an additional transition from the second refresh rate back to the first refresh rate, and wherein the array of pixels is operable to display the third image at the first refresh rate.

5. The display defined in claim 4 wherein the third level is greater than the first level.

6. The display defined in claim 5 wherein the digital-to-analog converter circuitry is operable to apply the time-varying scaling factor at the first level to image data for a fourth image after applying the time-varying scaling factor at the third level to the image data for the third image during the additional transition from the second refresh rate back to the first refresh rate, wherein the array of pixels is operable to display the fourth image at the first refresh rate.

7. The display defined in claim 1, wherein the pixels in the array of pixels each comprises an organic light-emitting diode (OLED).

8. The display defined in claim 1, wherein the pixels in the array of pixels each comprises a light-emitting diode.

9. The display defined in claim 1, wherein the digital-to-analog converter circuitry comprises gamma block circuitry.

10. The display defined in claim 1, wherein the digital-to-analog converter circuitry is configured to apply the time-varying scaling factor to the image data for the first and second images by multiplying the image data by the time-varying scaling factor.

11. The display defined in claim 1 wherein the pixels in the array of pixels each comprises a drive transistor having a gate terminal selectively coupled to a corresponding data line in the plurality of data lines, and wherein display driver circuitry is operable to provide the image data for the first and second images applied with the time-varying scaling factor to the gate terminals of the pixels in the array of pixels.

12. The display defined in claim 1 wherein the pixels in the array of pixels each comprises a storage capacitor selectively coupled to a corresponding data line in the plurality of data lines, and wherein the storage capacitors of the pixels in the array of pixels are configured to store the image data for the first and second images applied with the time-varying scaling factor.

13. The display defined in claim 1 wherein the first level is associated with a first scaling factor value and the second level is associated with a second scaling factor value.

14. The display defined in claim 13 wherein a given pixel in the array of pixels includes a storage capacitor, and wherein the storage capacitor is configured to store the image data for the first image applied with the time-varying scaling factor having the first scaling factor value for displaying the first image at the first refresh rate and is configured to store the image data for the second image applied with the time-varying scaling factor having the second scaling factor value for displaying the second image at the second refresh rate.

15. A method of operating a display, the method comprising:

with display driver circuitry, receiving image data for first and second different images, wherein the display driver circuitry includes digital-to-analog converter circuitry and wherein an array of pixels is coupled to the display driver circuitry using a plurality of data lines;

with the array of pixels, displaying the first image at a first refresh rate;

with the array of pixels, displaying the second image at a second refresh rate that is different than the first refresh rate after displaying the first image at the first refresh rate;

with the display driver circuitry, applying a time-varying scaling factor to the image data for the first and second images to reduce a flickering associated with a transition from the first refresh rate to the second refresh rate, wherein the time varying scaling factor is at a first level before the transition from the first refresh rate to the second refresh rate and is at a second level after the transition from the first refresh rate to the second refresh rate, and wherein the first level is different from the second level; and with the display driver circuitry, loading the image data for the first and second images applied with the time-varying scaling factor into the array of pixels using the plurality of data lines.

16. The method defined in claim 15, wherein the pixels in the array of pixels each comprises a drive transistor having a gate terminal selected coupled to a corresponding data line in the plurality of data lines, the method further comprising:

with the display driver circuitry, providing the image data for the first and second images applied with the time varying scaling factor to the gate terminals of the pixels in the array of pixels.

17. The method defined in claim 15, wherein the pixels in the array of pixels each comprises a storage capacitor selectively coupled to a corresponding data line in the plurality of data lines, the method further comprising:

using the storage capacitors of the pixels in the array of pixels, storing the image data for the first and second images applied with the time-varying scaling factor.

18. The method defined in claim 15, wherein the first level is associated with a first scaling factor value and the second level is associated with a second scaling factor value.

19. The method defined in claim 18, wherein a given pixel in the array of pixels includes a storage capacitor, the method comprising:

using the storage capacitor, storing the image data for the first image applied with the time-varying scaling factor having the first scaling factor value for displaying the first image at the first refresh rate; and using the storage capacitor, storing the image data for the second image applied with the time-varying scaling factor having the second scaling factor value for displaying the second image at the second refresh rate.

* * * * *